United States Patent [19]

Kates

[11] 4,454,609

[45] Jun. 12, 1984

[54] SPEECH INTELLIGIBILITY ENHANCEMENT

[75] Inventor: James M. Kates, Andover, Mass.

[73] Assignee: Signatron, Inc., Lexington, Mass.

[21] Appl. No.: 308,273

[22] Filed: Oct. 5, 1981

[51] Int. Cl.[3] ..... G10L 1/00; H04R 29/00

[52] U.S. Cl. ..... 381/68; 381/106

[58] Field of Search ..... 179/107 R, 107 FD, 1 P, 179/1 VL; 381/68, 94, 46, 104, 107

[56] References Cited

U.S. PATENT DOCUMENTS

| | | | |
|---|---|---|---|
| 3,292,116 | 12/1966 | Walker et al. | 381/103 |
| 3,992,584 | 11/1976 | Dugan | 381/107 |
| 4,061,874 | 12/1977 | Fricke et al. | 179/1 P |
| 4,099,035 | 7/1978 | Yanick | 179/1 P |
| 4,101,840 | 7/1978 | Fricke | 179/1 VL |
| 4,185,168 | 1/1980 | Graupe et al. | 179/1 P |

FOREIGN PATENT DOCUMENTS 2844979 4/1980 Fed. Rep. of Germany .

OTHER PUBLICATIONS

A. Risberg, "A Critical Review . . . On Hearing Aids", IEEE Transactions on Audio and Electroacoustics, vol. AU-17, No. 4, Dec. 1969, pp. 290-297.

Reger, "Difference in Loudness Response . . . ", Forty Germinal Papers in Human Hearing, (no date), pp. 202-204.

M. Mazor et al., "Moderate Frequency Compression . . . ", J. Acoust. Soc. Am., vol. 62, Nov. 1977, pp. 1273-1278 (reprinted as pp. 237-242).

Edgar Villchur, "Signal Processing . . . ", J. Acoust. Soc. Am., vol. 53, Jun. 1973, pp. 1646-1647 (reprinted as pp. 163-174).

Paul Yanick and Harris Drucker, "Signal Processing to Improve Speech . . . ", IEEE Transactions on Acoustics, Speech, and Signal Processing, vol. ASSP-24, No. 6, Dec. 1976, pp. 507-512.

Ian B. Thomas and G. Barry Pfannebecker, "Effects of Spectral Weighting", Journal of the Audio Engineering Society, vol. 22, No. 9, Nov. 1974, pp. 690-693.

Russell J. Niederjohn et al, "The Enhancement of Speech . . . ", IEEE Transactions on Acoustics, Speech, and Signal Processing, vol. ASSP-24, No. 4, Aug. 1976, pp. 277-282.

Siegfried G. Knorr, "Reliable . . . Decision," IEEE Transactions on Acoustics, Speech, and Signal Processing, vol. ASSP-27, No. 3, Jun. 1979, pp. 263-267.

Harris Drucker, "Speech Processing . . . ", IEEE Transactions on Audio and Electroacoustics, vol. AU-16, No. 2, Jun. 1968, pp. 165-168.

B. Gold and L. Rabiner, "Parallel Processing . . .", J. Acoust. Soc. Am., vol. 46, No. 2, (Part 2), Aug. 1969, pp. 442-448, reprinted as pp. 146-152.

Jae S. Lim and Alan V. Oppenheim, "Enhancement and Bandwidth . . . ", Proceedings of the IEEE, vol. 67, No. 12, Dec. 1979, pp. 1586-1604.

Golden, R. M., "Improving Naturalness", The Journal of the Acoustical Society of America, vol. 40, No. 3, Sep. 1966, New York, pp. 621-624, FIG. 1.

*Primary Examiner*—E. S. Matt Kemeny

*Attorney, Agent, or Firm*—Robert F. O'Connell

[57] ABSTRACT

In a communications system, consonant high frequency sounds are enhanced: the greater the high frequency content relative to the low, the more such high frequency content is boosted.

27 Claims, 9 Drawing Figures

SPEECH INTELLIGIBILITY ENHANCEMENT

This invention relates generally to the enhancement of the intelligibility of speech and more particularly to the enhancement of the consonant sounds of speech.

BACKGROUND OF THE INVENTION

It is desirable in many applications to enhance the intelligibility of speech when the speech has been processed electronically as, for example, in hearing aids, public address systems, radio or telephone communications, and the like. Although it is helpful to enhance the presentation of both vowel and consonant sounds, generally it appears that, since the intelligibility characteristics of speech depend to such a significant extent on consonant sounds, it is primarily desirable to enhance the intelligibility of such consonants.

Several approaches have characterized recent research into such intelligibility problems, particularly with respect to the hearing aid field. One approach has been to take the high frequency sounds in speech and transpose them to lower frequencies so that they fall within the band of normal hearing acuity, leaving the low frequency sounds unprocessed. Such approaches are discussed, for example, in the article "A Critical Review of Work on Speech Analyzing Hearing Aids" by A. Risberg, IEEE Trans. Audio and Electroacoustics, Vol. AU-17. No. 4, December 1969, pp. 290–297. The degree of success of such an approach appears to be quite limited and overall improvement in perceiving consonants, for example, was relatively small.

An alternate approach, akin to the frequency lowering technique, has been to slow down the overall speech, i.e., to lower the frequencies of the overall speech waveform thereby presenting the higher frequency content at lower frequencies within the listener's normal hearing band. If such a technique is used in real time, segments of the speech have to be removed in order to make room for the remaining temporally expanded segments and such process can generate distortion in the speech. Such techniques are discussed in the article "Moderate Frequency Compression for the Moderately Hearing Impaired", M. Mazor et al., J. Acoust. Soc. Am., Vol. 62, No. 5, November 1977, pp. 1273–1278. Although some slight improvement has been observed using such frequency compression techniques for up to about 20% frequency compression, for example, it was also noted that a further increase in frequency compression only tended to reduce intelligibility.

A basic problem with both high frequency transposition techniques and frequency compression schemes is that they tend to distort the temporal-frequency patterns of speech. Such distortion interferes with the cues needed by the listener to perceive the speech features. As a result such approaches tend to meet with only limited success in enhancing speech intelligibility.

Another approach to speech intelligibility enhancement is one which preserves the bandwidth of the speech and, instead, modifies the level and dynamic range of the speech waveform. The goal of such a speech processing approach is to make full use of the listener's high frequency hearing abilities. The hearing abilities of the hearing impaired are described, for example, in the article, "Differences in Loudness Response of the Normal and Hard of Hearing Ear at Intensity Levels Slightly above Threshold", by S. Reger, Ann. Otol., Rhinol., and Laryngol., Vol. 45, 1936, pp. 1029–1036. In this study of hearing impairment it was noted that soft sounds could not be perceived because of the loss in sensitivity, but that more intense sounds were perceived as having near-normal loudness. This phenomenon, sometimes referred to as "recruitment", has formed a motivation for improved hearing aid designs. Thus, an approach that tends to preserve the speech bandwidth and improves intelligibility by modifying the speech waveform dynamics and spectral energy appears to be a more effective approach than frequency transposition or frequency compression techniques because the features of the speech are better preserved. Although such an approach has achieved some success, as reported in the article "Signal Processing to Improve Speech Intelligibility for the Hearing Impaired" by E. Villchur, J. Acoust. Soc. Am., Vol. 53, pp. 1646–1657, June 1973, improvement is still needed to provide the most effective enhancement of the intelligibility of speech, particularly in the enhancement of consonant sounds.

BRIEF SUMMARY OF THE INVENTION

The system of the invention provides an improved and effective enhancement of the reproduction of consonant sounds by emphasizing the spectral content of consonants so as to intensify the consonant sound and, in effect, to equalize its intensity with that of vowel sounds, the latter sounds tending to achieve a normal intensity much greater than the normal consonant intensity. In accordance with the broadest approach of the invention, the system thereof processes an input speech signal by determining a short-time estimate of the spectral shape. The term "spectral shape" as used herein is intended to mean the spectral content of the input speech signal as a function of frequency relative to the spectral content at a specified frequency, or a specified frequency region, of the input speech signal. The term "spectral content" is intended to mean, for example, the energy content of the signal as a function of frequency, the envelope of the signal at a plurality of frequencies or in a plurality of frequency bands, the short-time Fourier transform coefficients of the signal, and the like. Control means are provided in response to such relative spectral shape estimate for dynamically controlling a modification of the spectral shape of the actual speech signal so as to produce an output speech signal.

Such modification can be achieved, for example, by first estimating the short-time spectral shape of the overall frequency spectrum of the input speech signal. One way of providing such estimate, for example, is to determine the spectral contents of different selected frequency bands within the overall spectrum, (e.g., the energy content in each band, the envelope in each band, the Fourier transform coefficients in each band, or the like) relative to the spectral content of one or more reference bands. This determination can be achieved by using Fourier transform techniques, filtering techniques, and the like. The estimated spectral shape of the overall input speech signal spectrum, however achieved, is then used to control, or modify, the spectral shape of the actual input signal, as, for example, by modifying the spectral content of one or more frequency bands of the input signal (which may or may not coincide with the previously mentioned selected frequency bands) to produce the output speech signal. The term "short-time" spectral shape, as used herein, means the spectral shape over a selected short time interval of between about 1 millisecond to about 30 milliseconds.

DESCRIPTION OF THE INVENTION

The invention can be described more particularly with reference to the accompanying drawings wherein FIG. 1 shows a broad block diagram of a system of the invention;

Figure 1:
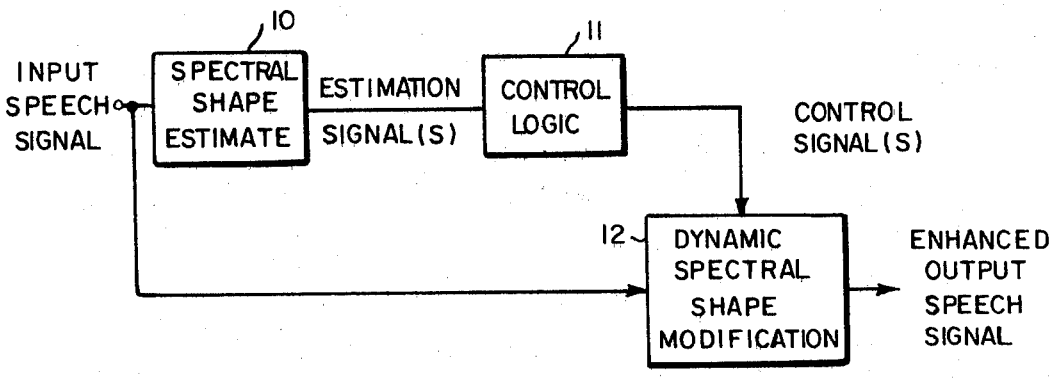

FIG. 1 depicts a broad block diagram of a system for processing an input signal in accordance with the techniques of the invention. As can be seen therein, an input speech signal is supplied to means 10 for estimating the spectral shape of the input speech signal. Such spectral shape estimation, when determined, provides one or more estimation signals for supply to a suitable control logic means 11 which is responsive to such spectral shape estimate for suitably controlling the dynamic modification of the spectral shape of the actual input speech signal via appropriate spectral shape modification means 12 to produce an enhanced output speech signal, as desired. The output speech can then be appropriately used wherever desired. For example, the output speech signal may be supplied to a suitable transmitter device or a system, e.g., a public address system or voice communication system, a radio broadcast transmitter, etc., or to a suitable receiver device, e.g., a hearing aid, a telephone receiver, an earphone, a radio, etc.

Figure 2:
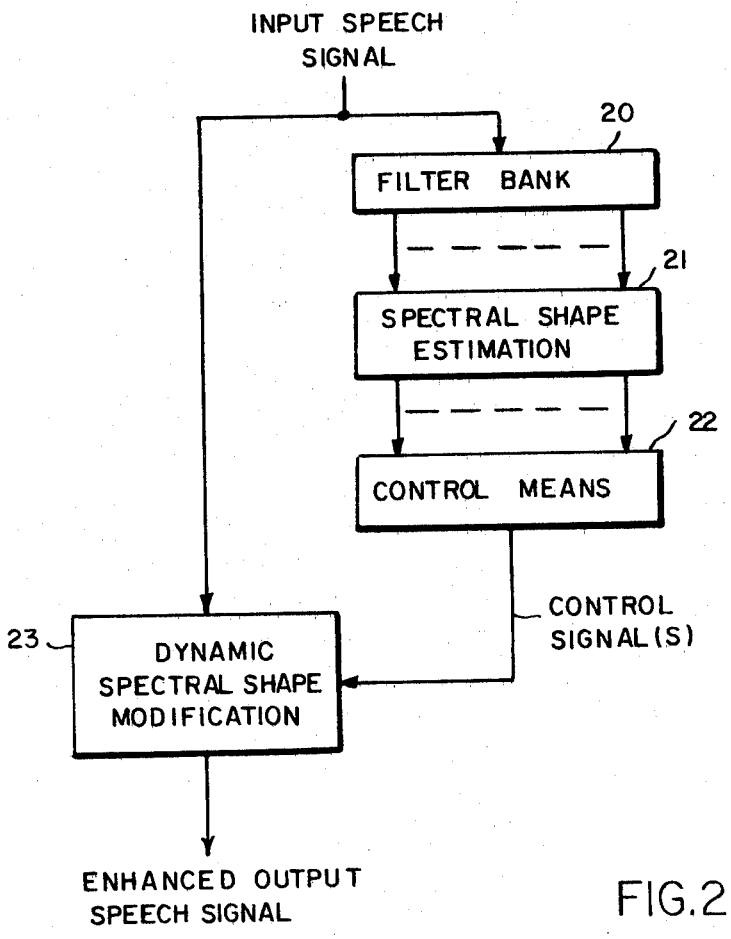
FIG. 2 shows a more specific block diagram of a system of the invention.

A particular approach in accordance with the general approach shown in FIG. 1 is depicted in FIG. 2 wherein the speech signal is supplied to a bank of filters 20, i.e., a plurality of bandpass filters for providing a plurality of frequency bands within the overall speech frequency spectrum of the input speech signal. An estimate of the spectral content in each frequency band relative to the spectral content in one or more reference bands is made in spectral shape estimation means 21 for supplying a plurality of estimation signals to control means 22 which in turn supplies one or more control signals for dynamically modifying the overall spectral shape of the input speech signal. For example, the control signal may select one of a plurality of different filters for modifying the spectral content of the input speech signal, the selection thereof depending on the particular estimate that was made. Alternatively, for example, a plurality of control signals may be generated to control a plurality of separate filters each of which corresponds to a selected pass band of the frequency spectrum of the input speech signal. The pass bands of the filter bank used to modify the actual input speech signal may or may not correspond to the pass bands of the filter bank so used to form the spectral shape estimates.

Figure 3:
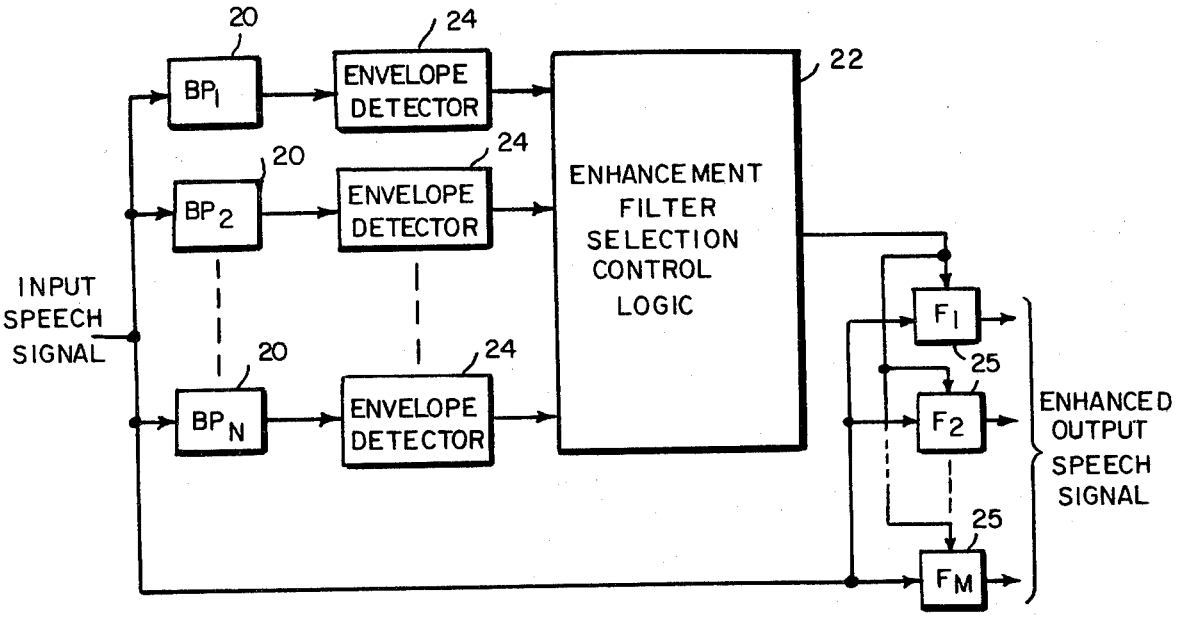
FIG. 3 shows a further more specific block diagram of a system of the invention.

FIG. 3 depicts a more specific block diagram of the above approach wherein the input speech signal is supplied to a selected number N of bandpass filters 20, designated as $BP_1$ through $BP_N$. The spectral shape of the input speech signal is determined by detecting the envelope characteristics of the outputs of each of the bandpass filters 20 using suitable envelope detectors 24. A control logic unit 22 is responsive to the outputs of envelope detectors 24 and provides a control signal which is used to select one suitable enhancement filter from a plurality of M such such filters 25, identified as filters $F_1$ through $F_M$, each having selected characteristics for dynamically modifying the shape of the overall spectrum of the input speech signal which is supplied thereto. The output from a selected one of such enhancement filters 25 thereby provides a desired consonant enhanced output speech signal.

Figure 4:
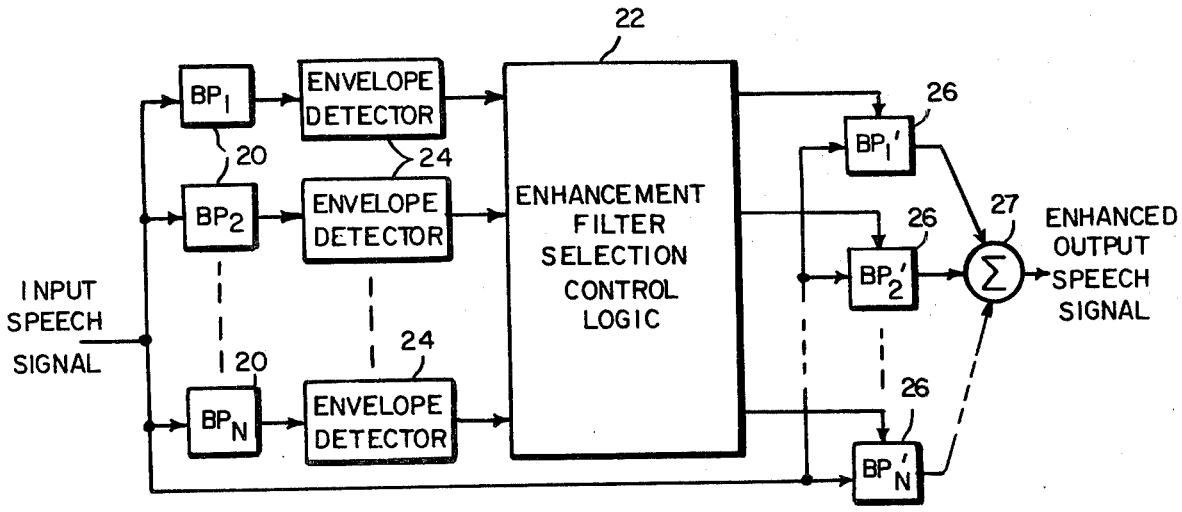
FIG. 4 shows a specific block diagram of an alternative enhancement of the invention depicted in FIG. 3.

Alternatively, FIG. 4 depicts a system similar to that of FIG. 3 wherein the selection control logic 22 provides a plurality of control signals, each supplied to one of a plurality of N band-pass filters 26, identified as $BP'_1$ through $BP'_N$, for modifying the spectral characteristics of the input speech signal in each pass-band. The modified outputs from each filter 26 are appropriately summed at summation circuit 27 to provide the desired consonant enhanced output speech signal.

Figure 5:
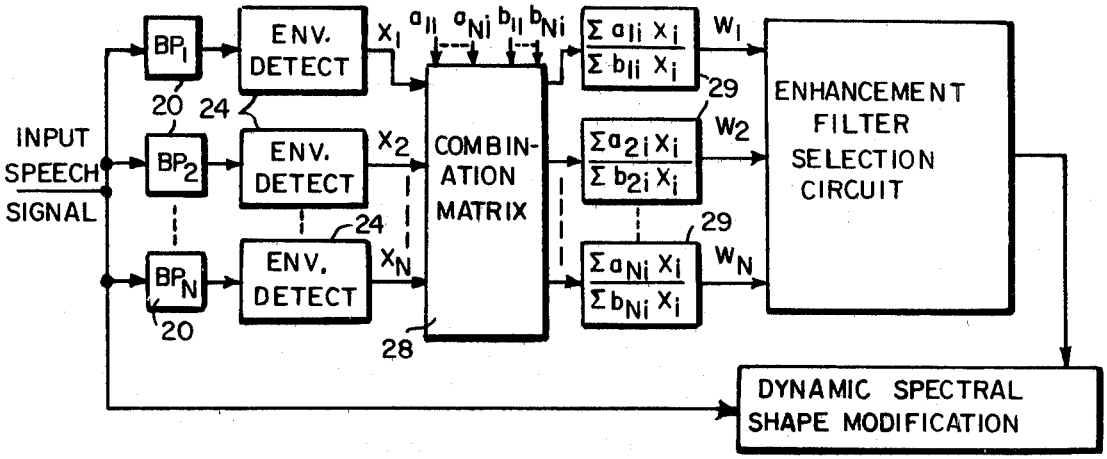
FIG. 5 shows a still more specific block diagram of a system of the invention.
Figure 6:
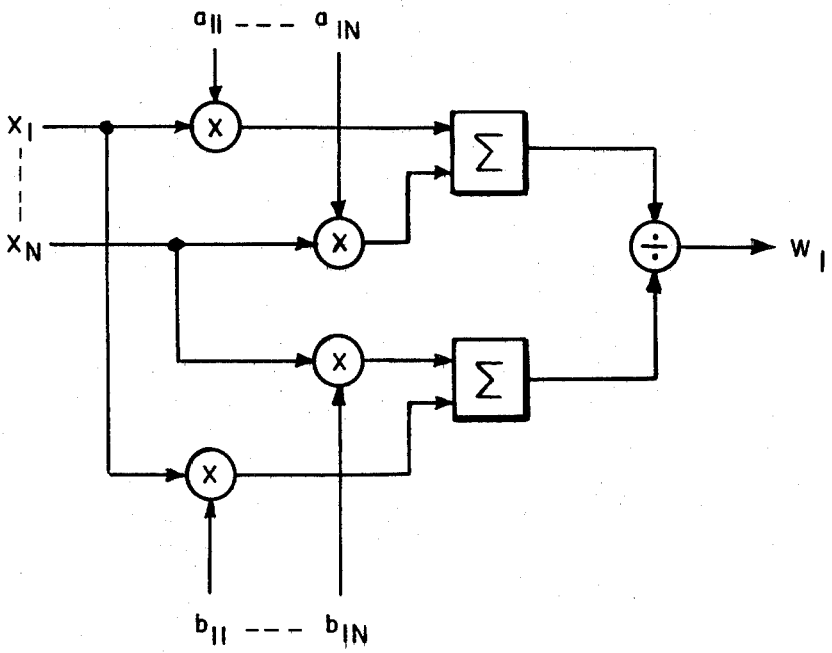
FIG. 6 shows more specifically the combination matrix circuit of the invention depicted in FIG. 5.

A specific embodiment of the speech enhancement of FIG. 3 is depicted in FIG. 5 wherein envelope detectors 24 produce a plurality of envelope detector signals $X_1 \ldots X_N$ which are supplied to combination matrix logic 28 to produce weighted signals $W_1 \ldots W_N$ each of which represents the ratios 29 as depicted. One stage of the combination logic matrix 28 for producing the weight $W_1$ is shown more specifically in FIG. 6 wherein a plurality of preselected constant coefficients $a_{11} \ldots a_{NN}$ and $b_{11} \ldots b_{NN}$ are used to multiply the envelope detected signals $X_1 \ldots X_N$. The summation of the multiplier outputs corresponding to the "a" coefficients are divided by the summation of the multiplier outputs corresponding to the "b" coefficients to form the weight $W_1$, as shown. Similar matrix steps are used to form weights $W_2 \ldots W_N$. The weights $W_1 \ldots W_N$ are supplied to selection circuitry for selecting an appropriate filter 25 in accordance therewith.

In a specific exemplary embodiment of the invention depicted in FIGS. 3 and 5, three band-pass filters 20 were chosen so that $BP_1$ covered 2–4 kHz, $BP_2$ covered 1–2 kHz, and $BP_3$ covered 0.5–1 kHz. The combination matrix 28 was chosen to give weights $W_1=X_1/X_3$, $W_2=X_2/X_3$, and $W_3=1$. In such case, for example, the weights are determined by a comparison of the relative energies among the bands, e.g., the envelope detected signal from one of the filters (e.g., $X_3$) is used as a reference and the energies in the other bands (e.g., $X_1$ and $X_2$) are, in effect, compared with such reference to provide the desired weights. For example, when the energy in a particular band ($X_1$) is large compared to that in the reference band ($X_3$), the weight $W_1$ is greater than unity, when the energies are equal the weight is unity, and when the energy is less than the reference band energy the weight is less than unity. For the specific weights discussed in the above example the coefficient matrices are as follows:

$$\begin{bmatrix} a_{11} & a_{12} & a_{13} \\ a_{21} & a_{22} & a_{23} \\ a_{31} & a_{32} & a_{33} \end{bmatrix} = \begin{bmatrix} 1 & 0 & 0 \\ 0 & 1 & 0 \\ 0 & 0 & 1 \end{bmatrix}$$

-continued $$\begin{bmatrix} b_{11} & b_{12} & b_{13} \\ b_{21} & b_{22} & b_{23} \\ b_{31} & b_{32} & b_{33} \end{bmatrix} = \begin{bmatrix} 0 & 0 & 1 \\ 0 & 0 & 1 \\ 0 & 0 & 1 \end{bmatrix}$$

Figure 7:
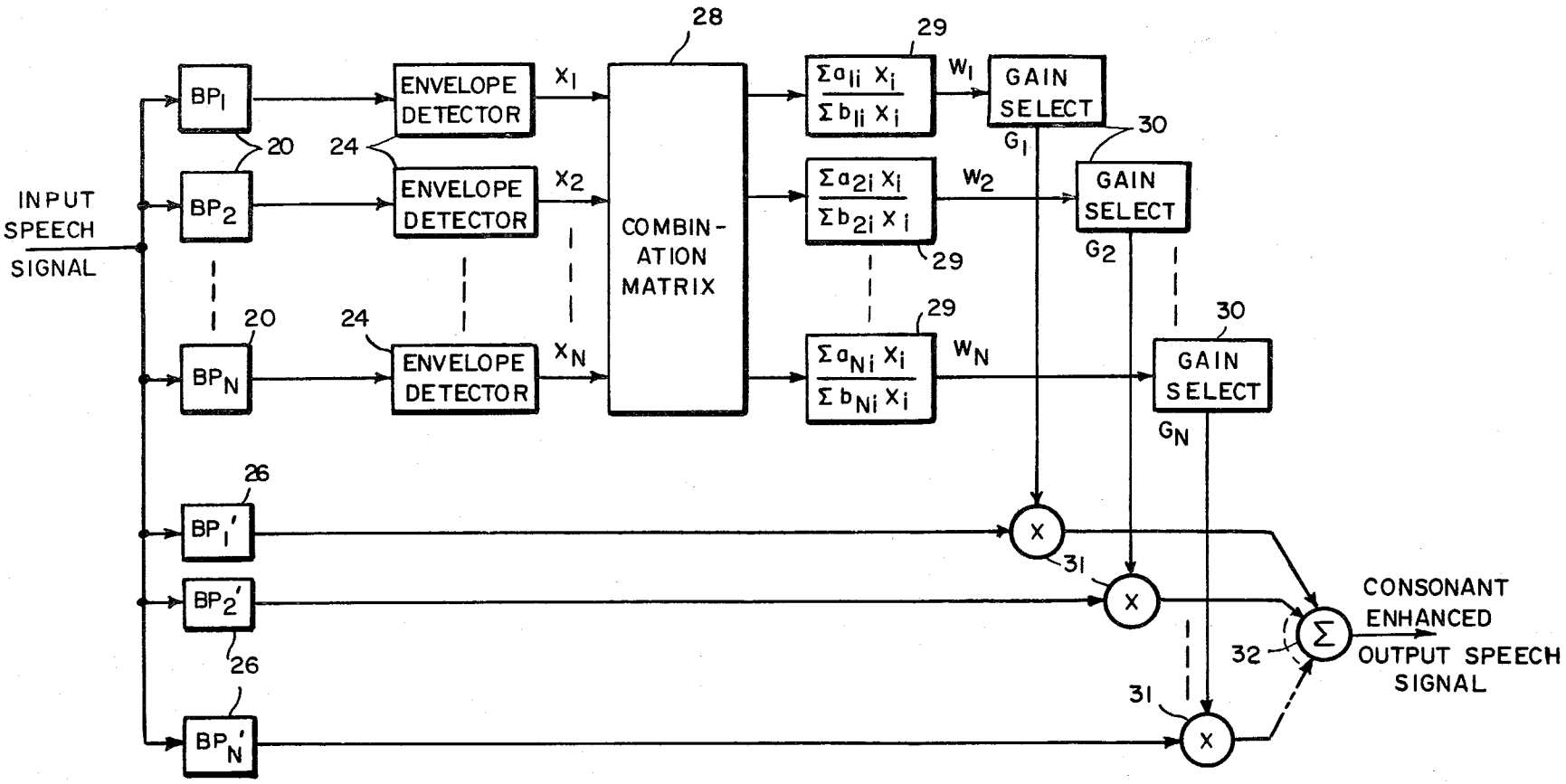
FIG. 7 shows a more specific block diagram of the invention.

The enhancement filter selection circuit at the output was chosen to contain three filters, one being a high-pass filter emphasizing the region above 2.5 kHz, one being a band-pass filter emphasizing the region from 1 kHz to 2.5 kHz, and the third being an all-pass filter having unity gain at all frequencies. The weights were then used by the selection circuit to form a composite filter which had a gain of 1 below 0.5 kHz and which gave a 3:1 dynamic range expansion when the associated weight for a given frequency band was above a pre-selected threshold. This composite filter was updated every millisecond to give the dynamic spectral shape modification desired. In a similar manner, FIG. 7 shows a more specific embodiment of the approach depicted in FIG. 4 wherein the input speech signal, as in the embodiment of FIG. 5, is supplied to band-pass filters 20 and envelope detectors 24. Combination matrix logic 28 combines the envelope detected outputs $X_1, X_2 \ldots X_N$, in a selected manner, as discussed above, to produce a plurality of weighting signals $W_1 \ldots W_N$ in the same general manner as discussed above with respect to FIGS. 5 and 6. In this case the weighting factors $W_1 \ldots W_N$ are used to select suitable gain constants $G_1 \ldots G_N$ at gain select logic 30 for multiplying the filtered outputs of bandpass filters 26, designated as $BP'_1 \ldots BP'_N$, as in FIG. 4, which filters separate the input speech signal into selected spectral bands. The filtered outputs from bandpass filters 26 are multiplied by the corresponding gains $G_1 \ldots G_N$ at multipliers 31, the outputs of which are added at summation circuit 32 to produce the consonant enhanced output speech signal.

The bandwidths of the input signals to multipliers 31 need not necessarily coincide with the bandwidths of the input signals to envelope detectors 24 and in the general case shown in FIG. 7 different portions of the frequency spectrum may be used for each bank of filters 20 and 26. In a simplified version thereof, the pass bands may coincide in which case the outputs of bandpass filters 20 can be supplied directly to multipliers 31 (as well as to envelope detectors 24) and the filter bank 26 eliminated.

In the embodiment of FIG. 7 the coefficients $a_{11} \ldots a_{NN}$ and $b_{11} \ldots b_{NN}$ are selected empirically and the weights are then used to provide gains which produce independent dynamic range expansions in the selected frequency bands. One effective approach is to select the gain by comparing the weight $W_i$ with a preselected threshold and to provide for unity gain when the weight is below the threshold and to provide an increased gain at or above such threshold. The increased gain may be selected logarithmically, i.e., in accordance with a selected power of the weight involved. For example, for suitable expansion on a db (logarithmic) scale the gain can be selected in accordance with the second power, i.e., $W_i^2$ when above the selected threshold, although effective expansion may also be achieved ranging from the first power ($W_i$) to the third power ($W_i^3$).

While the pass bands of the filters used in the above described embodiments of FIGS. 2–7 may be selected to provide pass bands which are clearly separated one from another, the degree of separation does not appear to significantly affect the consonant enhancement, although excessive separation would appear to have disadvantages in some applications. Further, some degree of overlapping of the pass bands does not appear to have an adverse effect on the overall enhancement operation.

In a specific example of the invention depicted in FIG. 7, for example, four band pass filters 20 are used (filters 26 were eliminated) such that $BP_1$ covers 2–5 kHz, $BP_2$ covers 1–2 kHz, $BP_3$ covers 0.5–1 kHz and $BP_4$ covers 0–0.5 kHz. The coefficients "a" and "b" are selected so as to provide weights $W_1=X_1/X_3$, $W_2=X_2/X_3$, $W_3=1$ and $W_4=1$. In each case the envelope detected outputs of each band relative to the envelope detected output of a reference band determines the weight. Thus, the weights $W_1$, $W_2$ and $W_3$ are determined by the envelope detected outputs $X_1$, $X_2$ and $X_3$ relative to the envelope detected output $X_3$, while $W_4$ is determined by the envelope detected output $X_4$ relative to $X_4$. Accordingly, the coefficients are selected as follows:

$$\begin{bmatrix} a_{11} & a_{12} & a_{13} & a_{14} \\ a_{21} & a_{22} & a_{23} & a_{24} \\ a_{31} & a_{32} & a_{33} & a_{34} \\ a_{41} & a_{42} & a_{43} & a_{44} \end{bmatrix} \begin{bmatrix} 1 & 0 & 0 & 0 \\ 0 & 1 & 0 & 0 \\ 0 & 0 & 1 & 0 \\ 0 & 0 & 0 & 1 \end{bmatrix}$$

$$\begin{bmatrix} b_{11} & b_{12} & b_{13} & b_{14} \\ b_{21} & b_{22} & b_{23} & b_{24} \\ b_{31} & b_{32} & b_{33} & b_{34} \\ b_{41} & b_{42} & b_{43} & b_{44} \end{bmatrix} \begin{bmatrix} 0 & 0 & 1 & 0 \\ 0 & 0 & 1 & 0 \\ 0 & 0 & 1 & 0 \\ 0 & 0 & 0 & 1 \end{bmatrix}$$

The gains are selected as follows:

If $W_1<2$, $G_1=1$ $W_1 \geqq 2$, $G_1=W_1^2/4$

If $W_2<2$, $G_2=1$ $W_2 \geqq 2$, $G_2=W_2^2/4$ $G_3=G_4=1$ (always)

A further improvement can be made in the approach of the invention by using the modifications discussed with reference to FIGS. 8 and 9 which are designed to take into better account the background noise present in the input speech signal. If an estimate of such background noise is made and the effects of such noise is appropriately removed in the spectral shape estimate control operation the consonant enhancement can be further improved.

Figure 8:
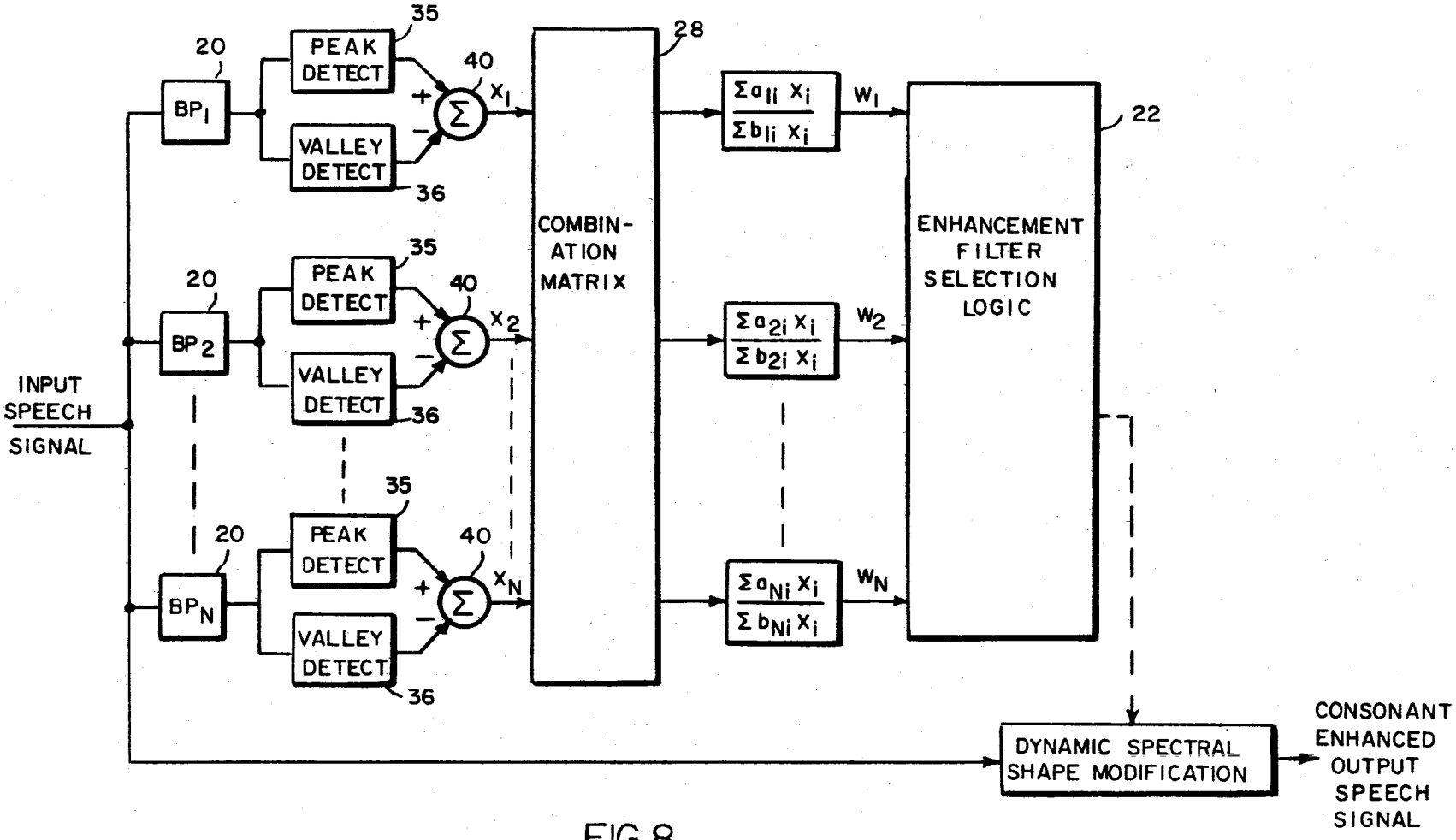
FIG. 8 shows a further specific block diagram of another alternative embodiment of the invention.
Figure 9:
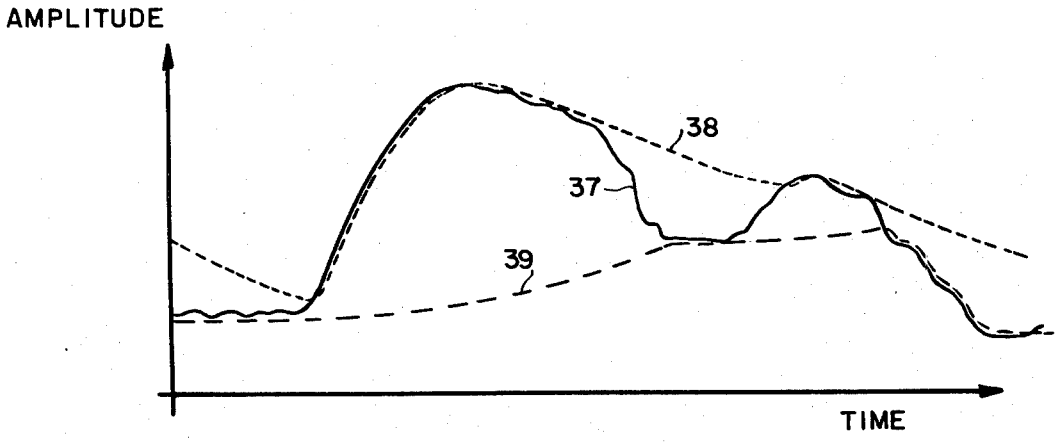
FIG. 9 shows a graph of the amplitude envelope characteristics as a function of time as obtained at the exemplary point in the embodiment of the invention depicted in FIG. 8.

A technique for such operation is depicted in FIG. 8 wherein the outputs of each of the bandpass filters 20 are supplied both to peak detectors 35 and to valley detectors 36. The peak detectors follow the peaks of the signal by rising rapidly as the signal increases but falling slowly when the signal level decreases. The valley detectors follow the mimima of the signal by falling rapidly as the signal decreases but rising slowly when the signal level increases. The time constant of the peak detector decay is in general much shorter than that of the valley detector rise. Thus, the output waveforms from such detectors tend to be of the exemplary forms shown in FIG. 9 wherein the solid line 37 represents an input to the detectors 35 and 36 from a bandpass filter 20, the dotted line 38 represents the peak detector output waveform and the dashed line 39 represents the valley detector output waveform.

The valley detected output signal tends to represent the background noise present in the input speech signal and if such signal is subtracted at subtractors 40 from the peak detected output (which, in effect, represents the desired signal plus background noise), the signals $X_1 \ldots X_N$ provide improved spectral shape estimates which can then be suitably combined as in the combination matrix means 28 for providing the weighted signals $W_1 \ldots W_N$ as before.

While the specific implementations discussed above are disclosed to show particular embodiments of the invention, the invention is not limited thereto. Modifications thereto within the spirit and scope of the invention will occur to those in the art. For example, instead of using discrete filters, as shown by the filter bands discussed above, other techniques for determining the spectral content in selected frequency bands can be used, such as fast Fourier transform (FFT) techniques, chirp-z (CZT) techniques, and the like. Moreover, the spectral content need not be the envelope detected output but can be an energizing detected output, the Fourier transform coefficients in a Fourier transform process, or other characteristics representative of the spectral content involved. Hence, the invention is not to be construed as limited to the particular embodiments described except as defined by the appended claims.

What is claimed is:

1. A system for processing an input speech signal comprising means responsive to said input speech signal for estimating the short-time spectral content of said input speech signal as a function of frequency relative to the short-time spectral content at a specified frequency or frequency region of said input speech signal:

control means responsive to said spectral content estimate for determining when consonants are present in said input speech signal and for providing one or more control signals; and means responsive to said one or more control signals for dynamically modifying the short-time spectral content of said input speech signal to produce an output speech signal in which said consonants are enhanced.

2. A system in accordance with claim 1 wherein the estimating means estimates the short-time spectral content in each of a plurality of selected frequency bands relative to the short-time spectral content in one or more of said frequency bands.

3. A system in accordance with claims 1 or 2 wherein said estimating means includes means for separating said input speech signal into a plurality of selected frequency bands; and means responsive to the portions of said input speech signal in each of said frequency bands for estimating the short-time spectral content in each of said frequency bands relative to the short-time spectral content in a selected one or more of said frequency bands;

said control means being responsive to the short-time spectral content estimates in said frequency bands for producing said one or more control signals.

4. A system in accordance with claim 3 wherein said separating means is a band of filters.

5. A system in accordance with claim 3 wherein said estimating means includes a plurality of envelope detection means for detecting the envelope characteristics of said input speech signal in each of said frequency bands; and said control means is responsive to said envelope characteristics for providing said one or more control signals.

6. A system in accordance with claim 5 wherein said control means includes means responsive to said envelope characteristics for providing a plurality of weighting signals; and means responsive to said weighting signals for producing said one or more control signals.

7. A system in accordance with claims 1, 2, 3, 4, 5 or 6 wherein said modifying means includes a plurality of filter circuits each having a different characteristic over the frequency spectrum of said input speech signal; and means responsive to said one or more control signals for selecting one of said plurality of filter circuits to modify said input speech signal so as to produce said output speech signal.

8. A system in accordance with claims 2, 3, 4, 5 or 6 wherein said modifying means includes means responsive to a plurality of control signals for modifying the spectral content of the input speech signal in each of said selected frequency bands; and means for combining the modified input speech signal in each of said selected frequency bands to produce said output speech signal.

9. A system in accordance with claim 8 wherein said modifying means provides a plurality of selectable gains for multiplying the amplitude of the input speech signal by a selected gain factor in each of said selected frequency bands.

10. A system in accordance with claims 2, 3, 4, 5 or 6 wherein said modifying means includes a plurality of second filter means for separating said input speech signal into a plurality of second selected frequency bands;

means responsive to a plurality of control signals for modifying the spectral content of the input speech signal in each of said second selected frequency bands; and means for combining the modified input speech signal in each of said second selected frequency bands to produce said output speech signal.

11. A system in accordance with claim 10 wherein said modifying means provides a plurality of selectable gains for multiplying the amplitude of the input speech signal by a selected gain factor in each of said second selected frequency bands.

12. A system in accordance with claim 6 wherein said weighting signal producing means includes matrix means responsive to said envelope characteristics for multiplying said envelope characteristics by a plurality of second coefficient values; and means for combining said multiplied envelope characteristics so as to produce said weighting signals.

13. A system in accordance with claim 12 wherein said combining means includes means for combining envelope characteristics multiplied by said first coefficients to produce a plurality of first combined signals;

means for combining said envelope characteristics multiplied by said second coefficients to produce a plurality of second combined signals;

means for determining a plurality of ratios of said plurality of first and second combined signals, said ratios representing said weighting signals.

14. A system in accordance with claim 9 wherein said gain factors are selected so as to provide first selected gains when said weighting signals are below selected levels and second selected gains when said weighting signals are at or above said selected levels.

15. A system in accordance with claim 14 wherein said first selected gains are unity below said selected levels.

16. A system in accordance with claim 15 wherein said second selected gains are proportional to $W^N$, where W is the weighting signal for a selected band and N is a selected exponent.

17. A system in accordance with claim 16 where N is selected as equal to a value within a range from about 1 to about 3.

18. A system in accordance with claim 17 wherein N is selected as equal to 2.

19. A system in accordance with claim 5 wherein said envelope detection means detects the peaks of said envelope characteristics and the valleys of said envelope characteristics in each of said frequency bands.

20. A system in accordance with claim 19 and further including means for subtracting said valley envelope characteristics from said peak envelope characteristics to form combined envelope characteristics in each said frequency band and said control means in response to said combined envelope characteristics.

21. A method for processing an input speech signal comprising the steps of estimating the short-time spectral content of said speech signal as a function of frequency relative to the short-time spectral content at a specified frequency or frequency region of said input speech signal determining when consonants are present in said input signal in accordance with said short-time spectral content estimate; and dynamically modifying the short-time spectral content of said input speech signal in accordance with said determination to produce an output speech signal in which said consonants are enhanced.

22. A method in accordance with claim 21 wherein said dynamic modification includes the steps of producing one or more control signals in accordance with said determination; and controlling the dynamic modification of the short-time spectral content of said input speech signal in accordance with said control signals.

23. A method in accordance with claims 21 or 22 wherein said estimating step includes the steps of estimating the short-time spectral contents of each of a plurality of first separate frequency bands of said input speech signal relative to the short-time spectral content of one or more of said frequency bands.

24. A method in accordance with claim 23 wherein said dynamic modification step includes the step of selecting a filter means having a spectral response specified in accordance with said estimate.

25. A method in accordance with claim 23 wherein said dynamic modification step includes the step of dynamically modifying the short-time spectral content of said input speech signal in a plurality of second separate frequency bands in accordance with said estimate.

26. A method in accordance with claim 25 wherein the plurality of first separate frequency bands substantially coincides with the plurality of second separate frequency bands.

27. A method in accordance with claim 25 wherein the plurality of first separate frequency bands are different from the plurality of second separate frequency bands.

* * * * *